US011835328B2

(12) United States Patent
Hwang

(10) Patent No.: US 11,835,328 B2
(45) Date of Patent: Dec. 5, 2023

(54) GROUND-FIXABLE ELECTRONIC DETONATION DEVICE FOR BLASTING SYSTEM AND BLASTING SYSTEM USING SAME

(71) Applicant: HANWHA CORPORATION, Seoul (KR)

(72) Inventor: Ki Won Hwang, Cheongju-si (KR)

(73) Assignee: HANWHA CORPORATION, Seoul (KR)

( * ) Notice: Subject to any disclaimer, the term of this patent is extended or adjusted under 35 U.S.C. 154(b) by 617 days.

(21) Appl. No.: 17/252,497

(22) PCT Filed: Dec. 4, 2020

(86) PCT No.: PCT/KR2020/017593
§ 371 (c)(1),
(2) Date: Dec. 15, 2020

(87) PCT Pub. No.: WO2021/118167
PCT Pub. Date: Jun. 17, 2021

(65) Prior Publication Data

US 2022/0299304 A1 Sep. 22, 2022

(30) Foreign Application Priority Data

Dec. 10, 2019 (KR) ..... 10-2019-0164042

(51) Int. Cl.
*F42D 1/05* (2006.01)
*F42C 13/04* (2006.01)

(52) U.S. Cl.
CPC ..... *F42D 1/05* (2013.01); *F42C 13/047* (2013.01)

(58) Field of Classification Search
CPC ..... F42D 1/05; F23Q 21/00; F42C 13/047
See application file for complete search history.

(56) References Cited

U.S. PATENT DOCUMENTS

2010/0005994 A1* 1/2010 Jacobson ..... F42B 1/02 102/215
2014/0123866 A1 5/2014 Givens et al.
2016/0223310 A1* 8/2016 Morris ..... F42C 13/06
2019/0119066 A1 4/2019 Muller et al.

FOREIGN PATENT DOCUMENTS

KR 20-0391396 Y1 8/2005
KR 10-1485777 B1 2/2015
KR 10-2016-0077690 A 7/2016

* cited by examiner

*Primary Examiner* — Gary L Laxton
(74) *Attorney, Agent, or Firm* — WHDA, LLP

(57) ABSTRACT

A ground-fixable electronic detonation device for a blasting system and a blasting system using same are proposed. The ground-fixable electronic detonation device includes: an electronic detonator; a wireless communication module; a wire part configured to connect the electronic detonator and the wireless communication module; and a module fixing pin part positioned in the wireless communication module and configured to move upward and downward to be driven into the ground. In the ground-fixable electronic detonation device, the module fixing pin part is driven into the ground to stably fix a position of the wireless communication module, so that stability in wireless communication is secured. Accordingly, blasting accuracy may be improved.

20 Claims, 12 Drawing Sheets

【FIG. 1】
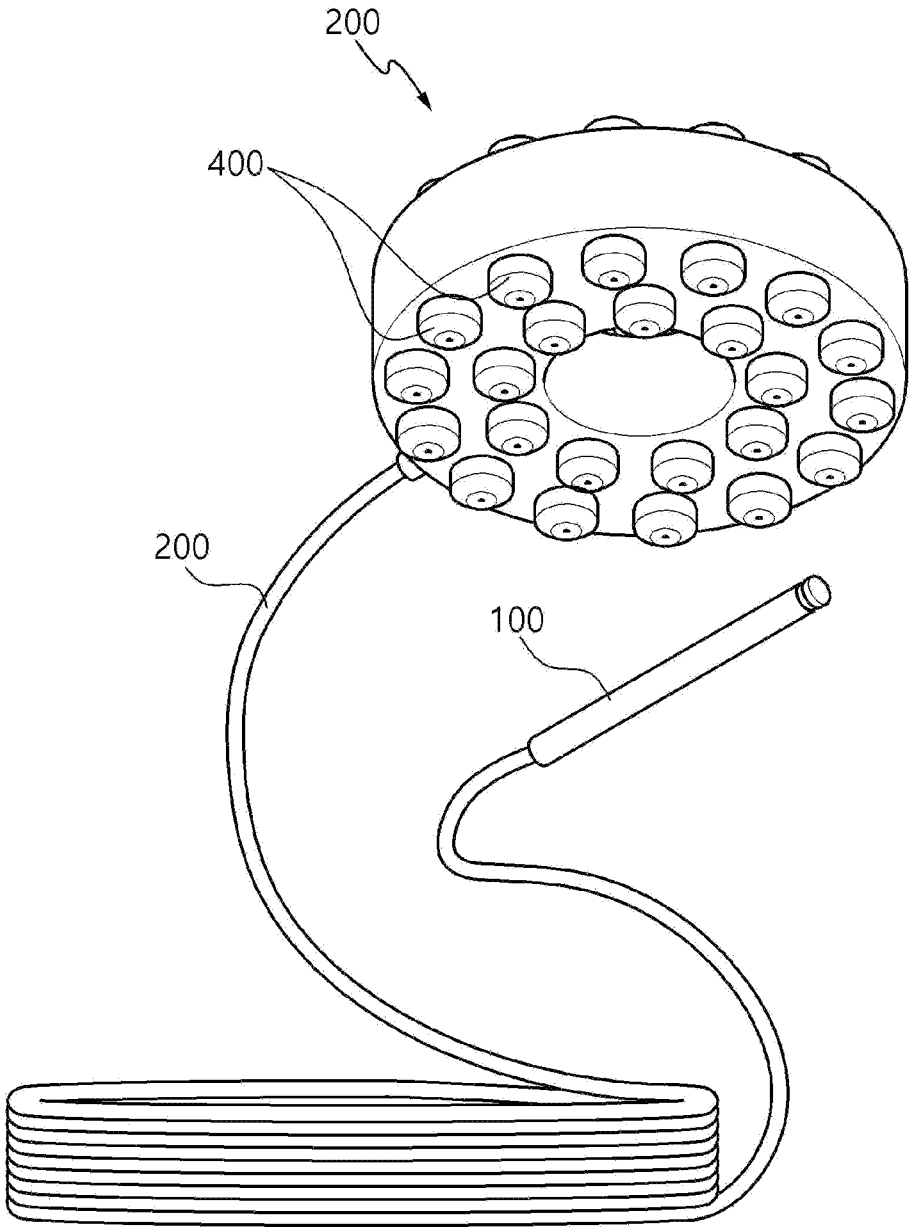

【FIG. 2】
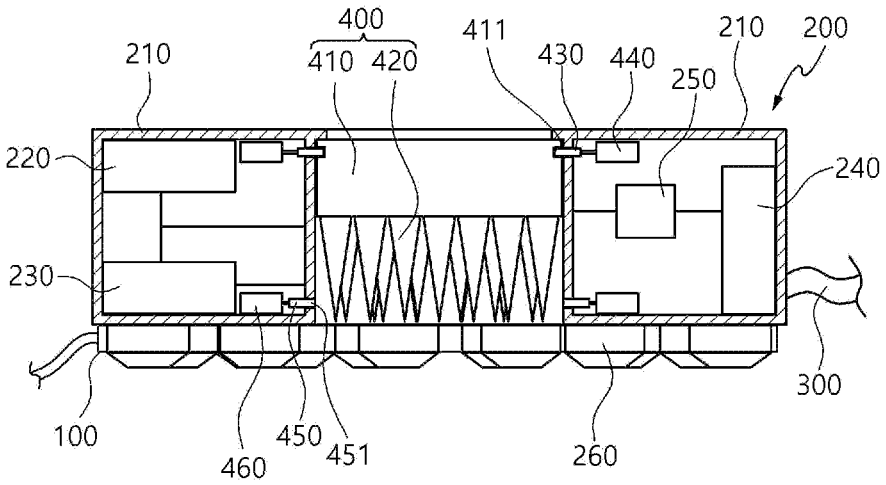

【FIG. 3】
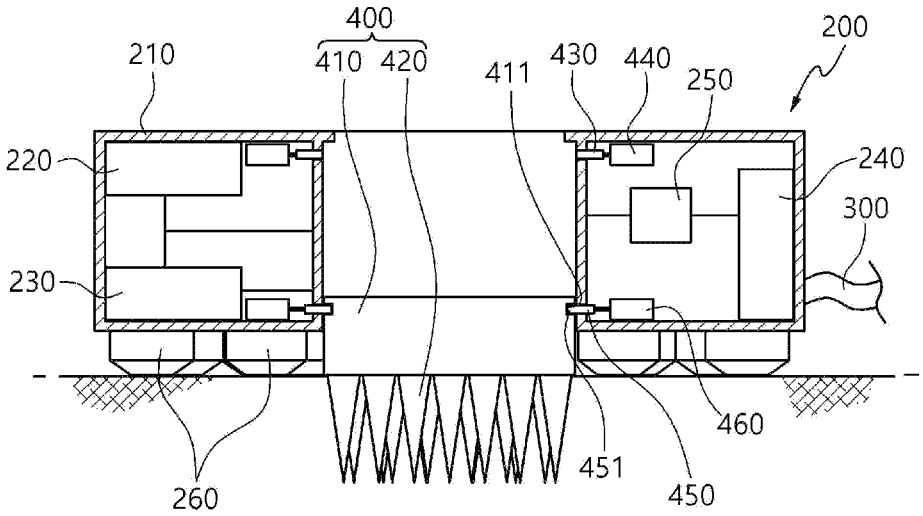

【FIG. 4】
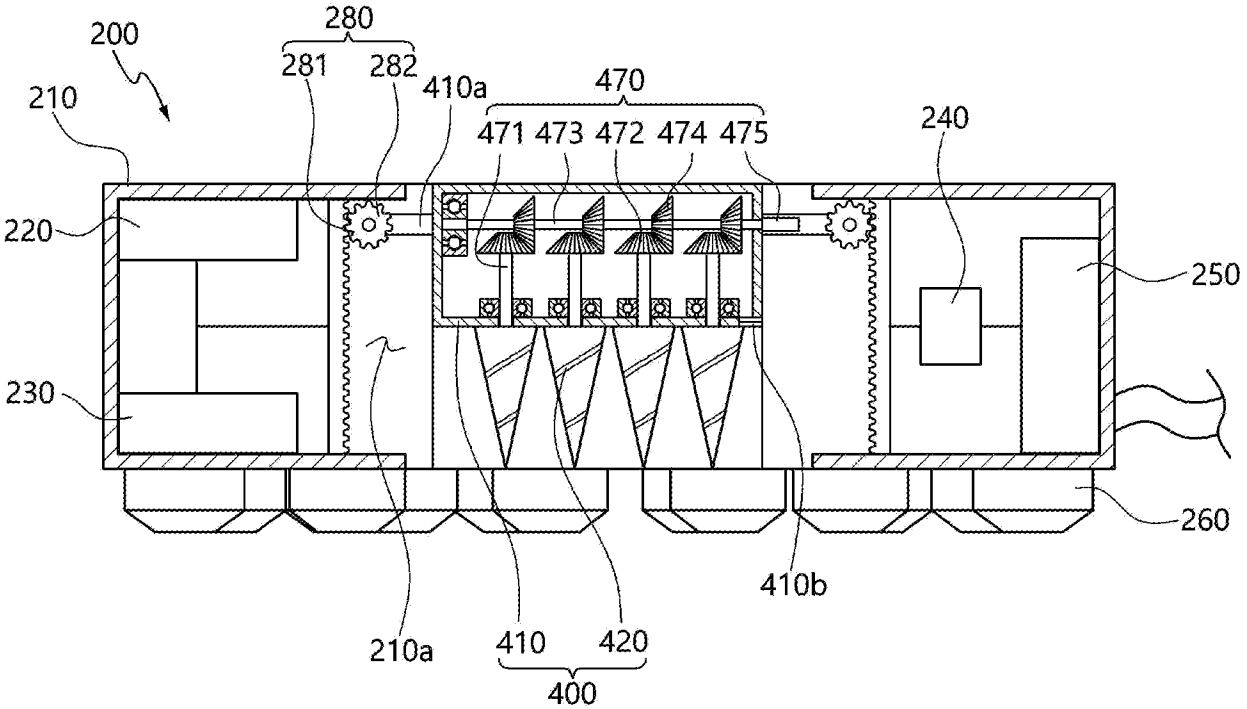

【FIG. 5】
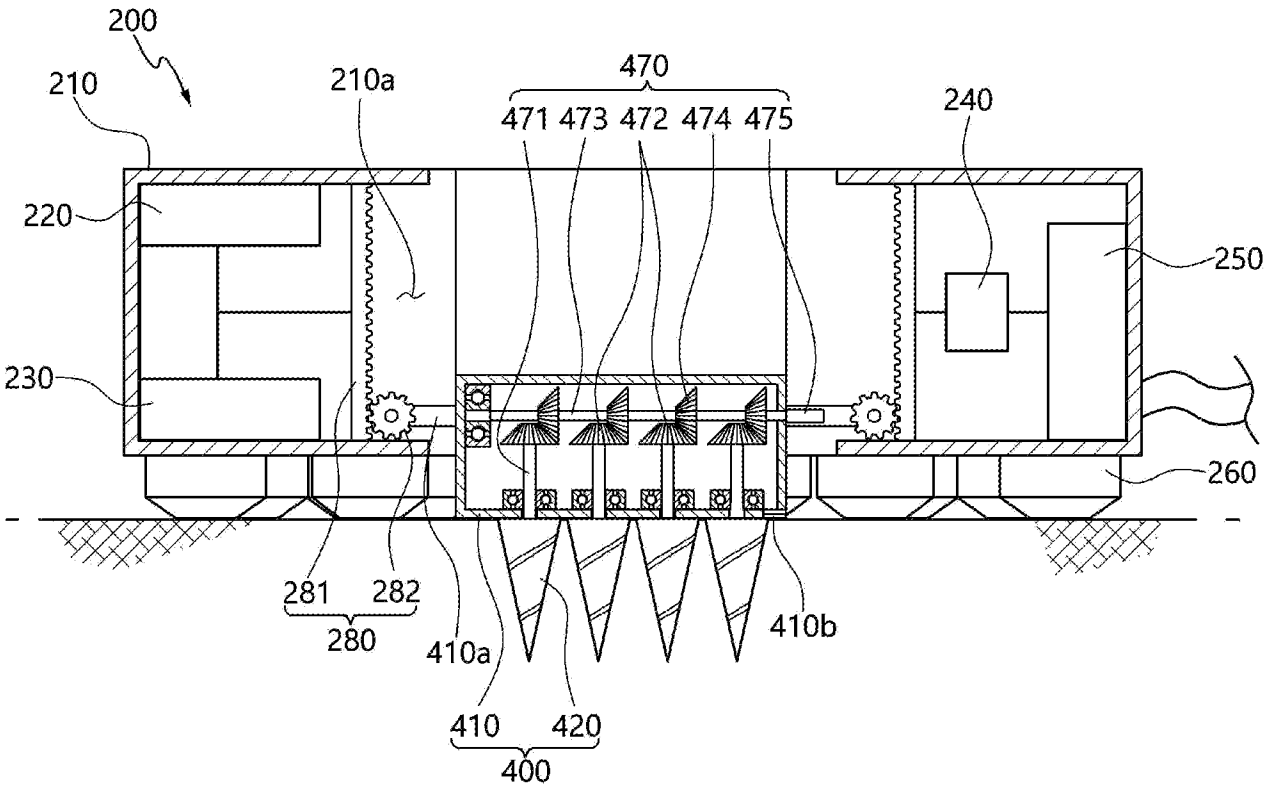

[FIG. 6]
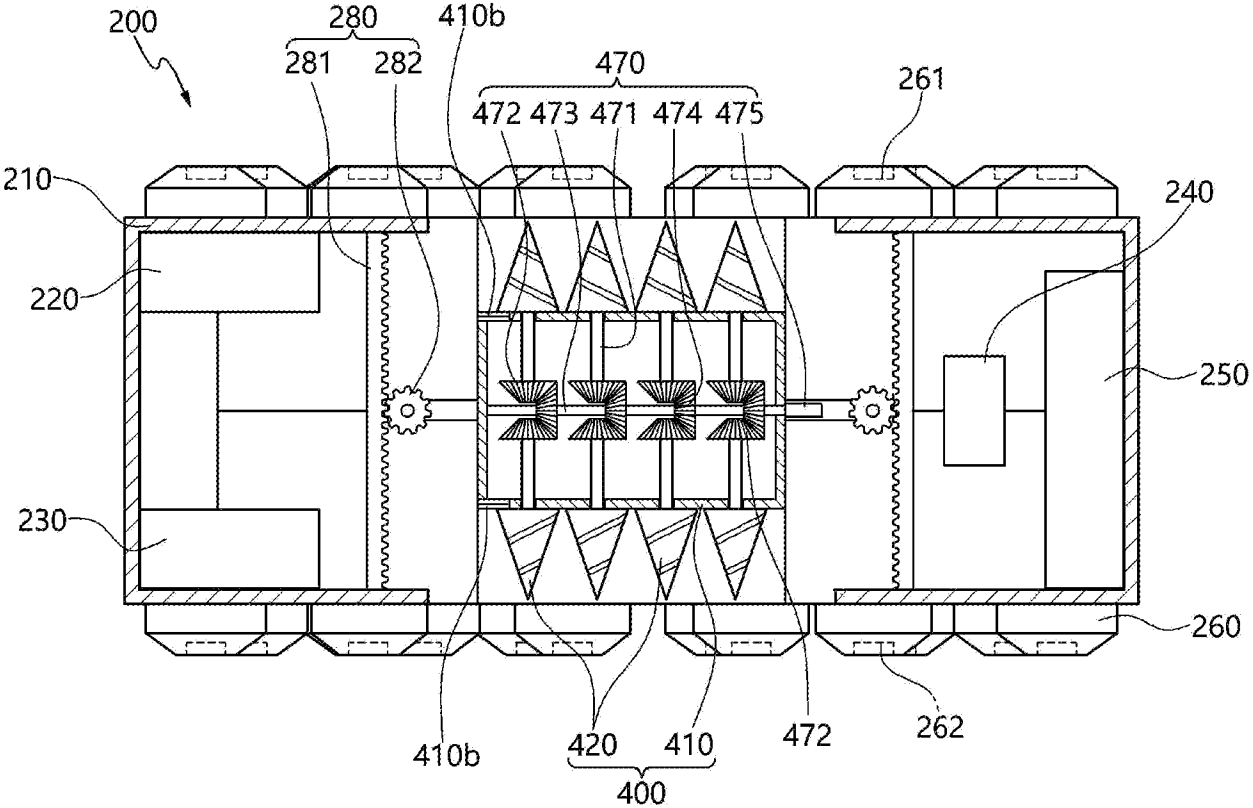

[FIG. 7]
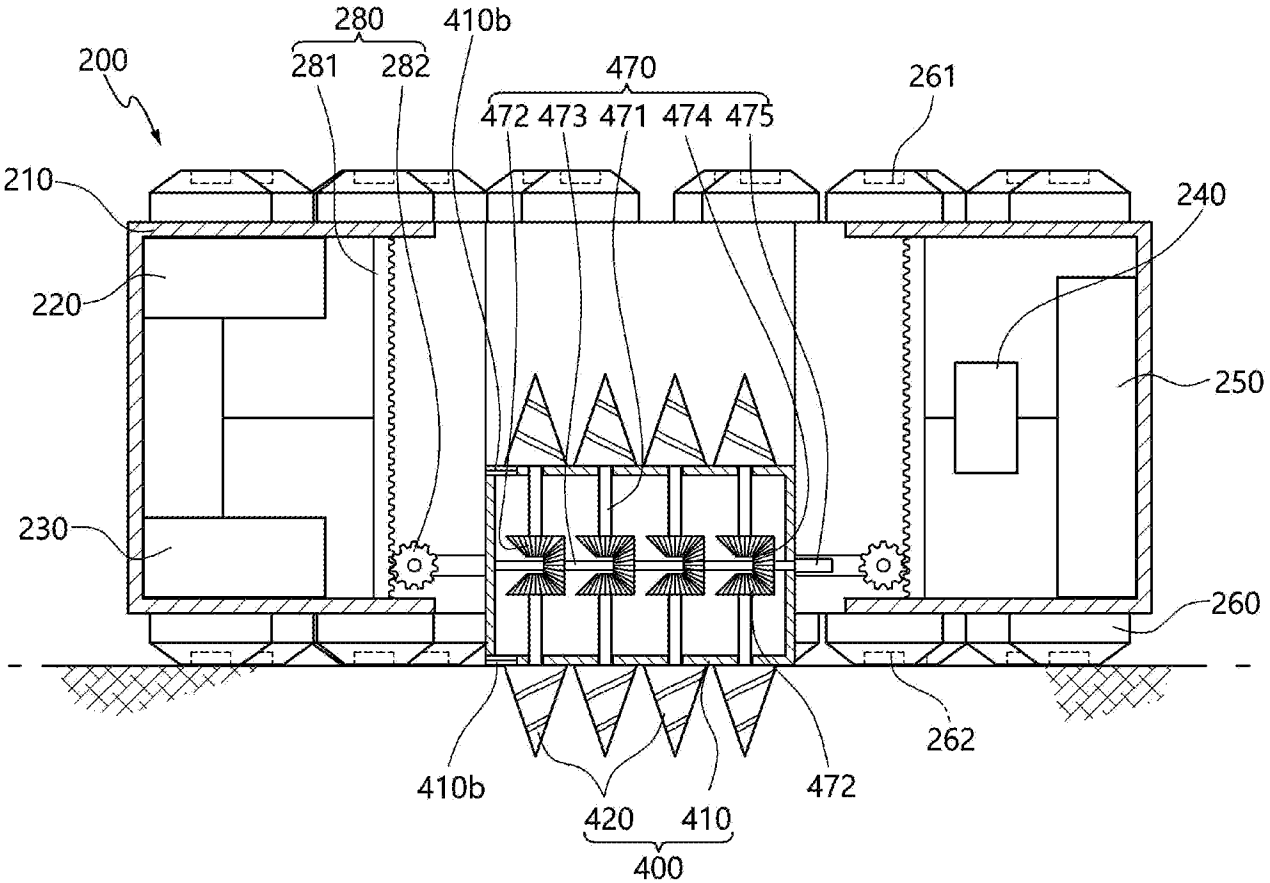

【FIG. 8】
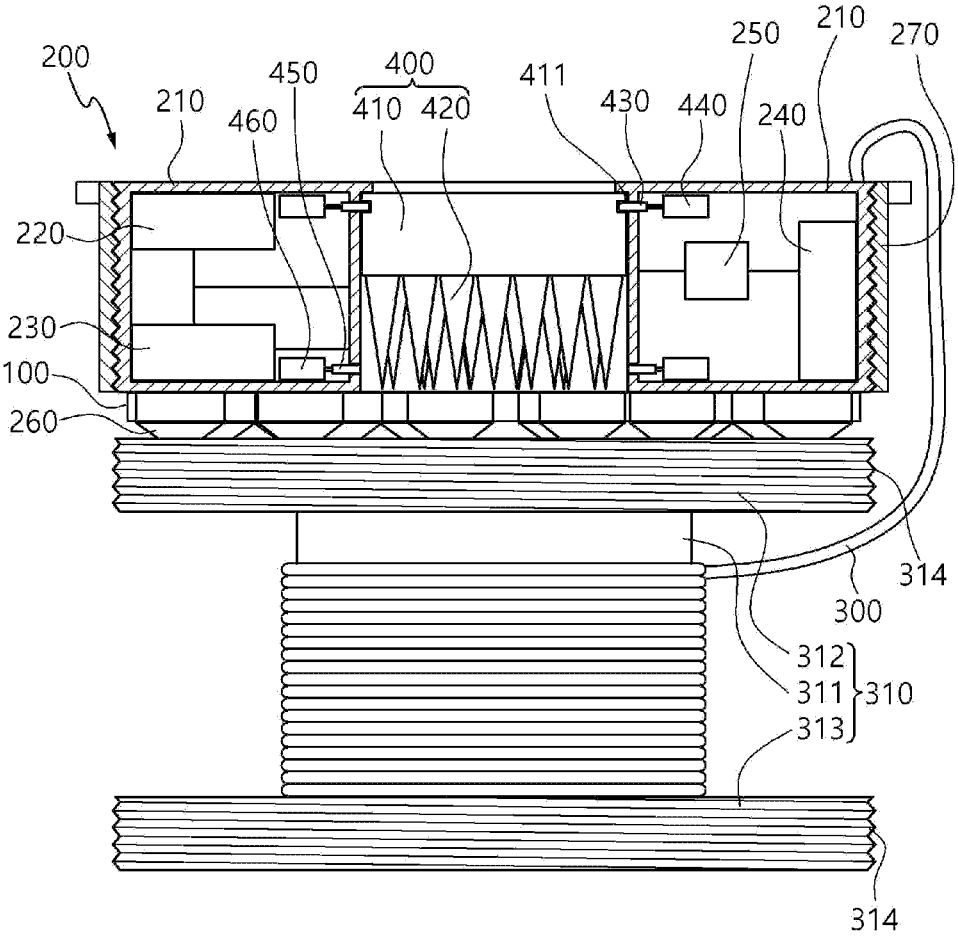

【FIG. 9】
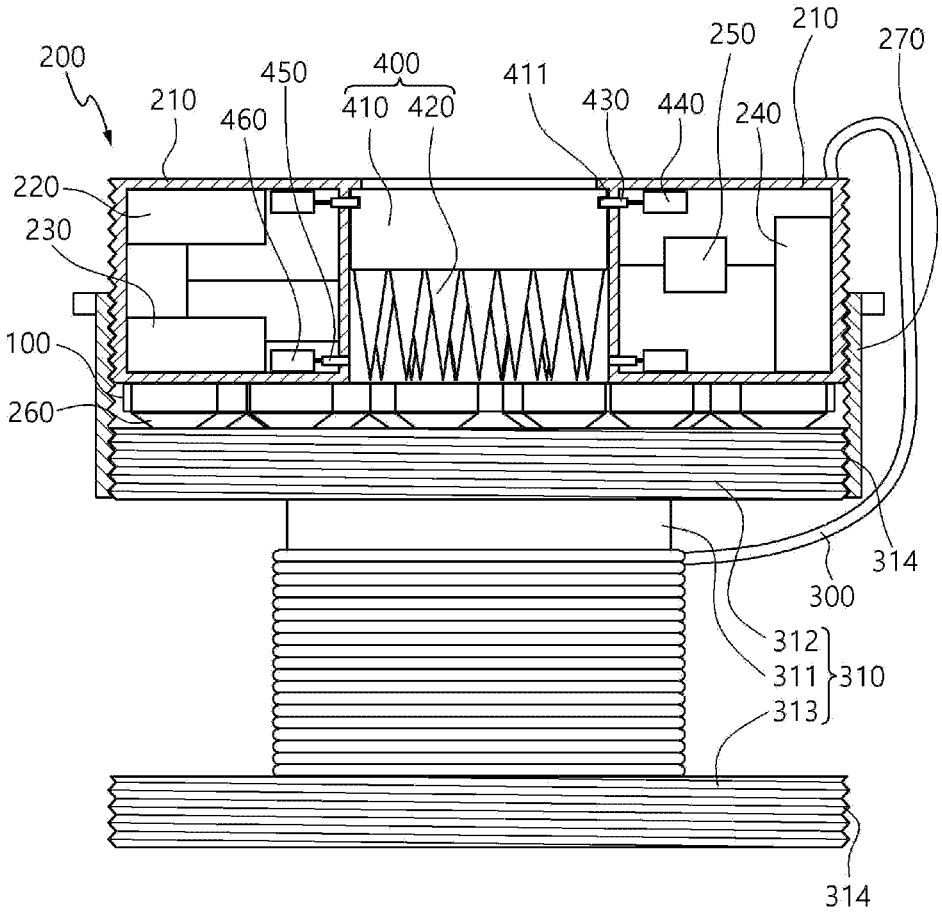

【FIG. 10】
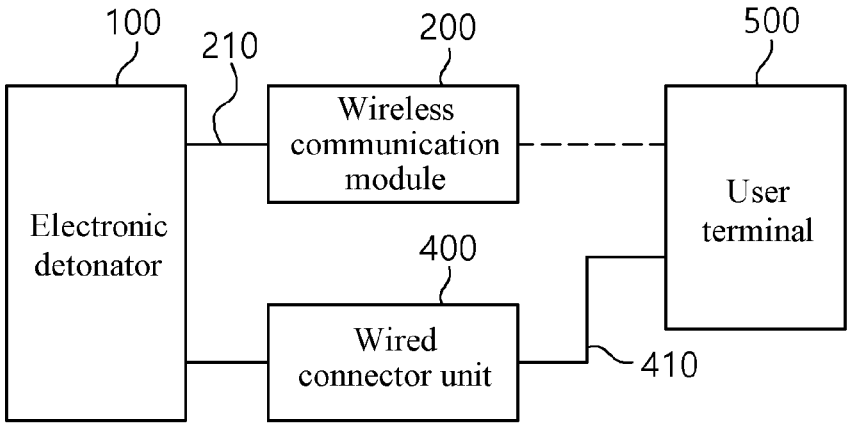

【FIG. 11】
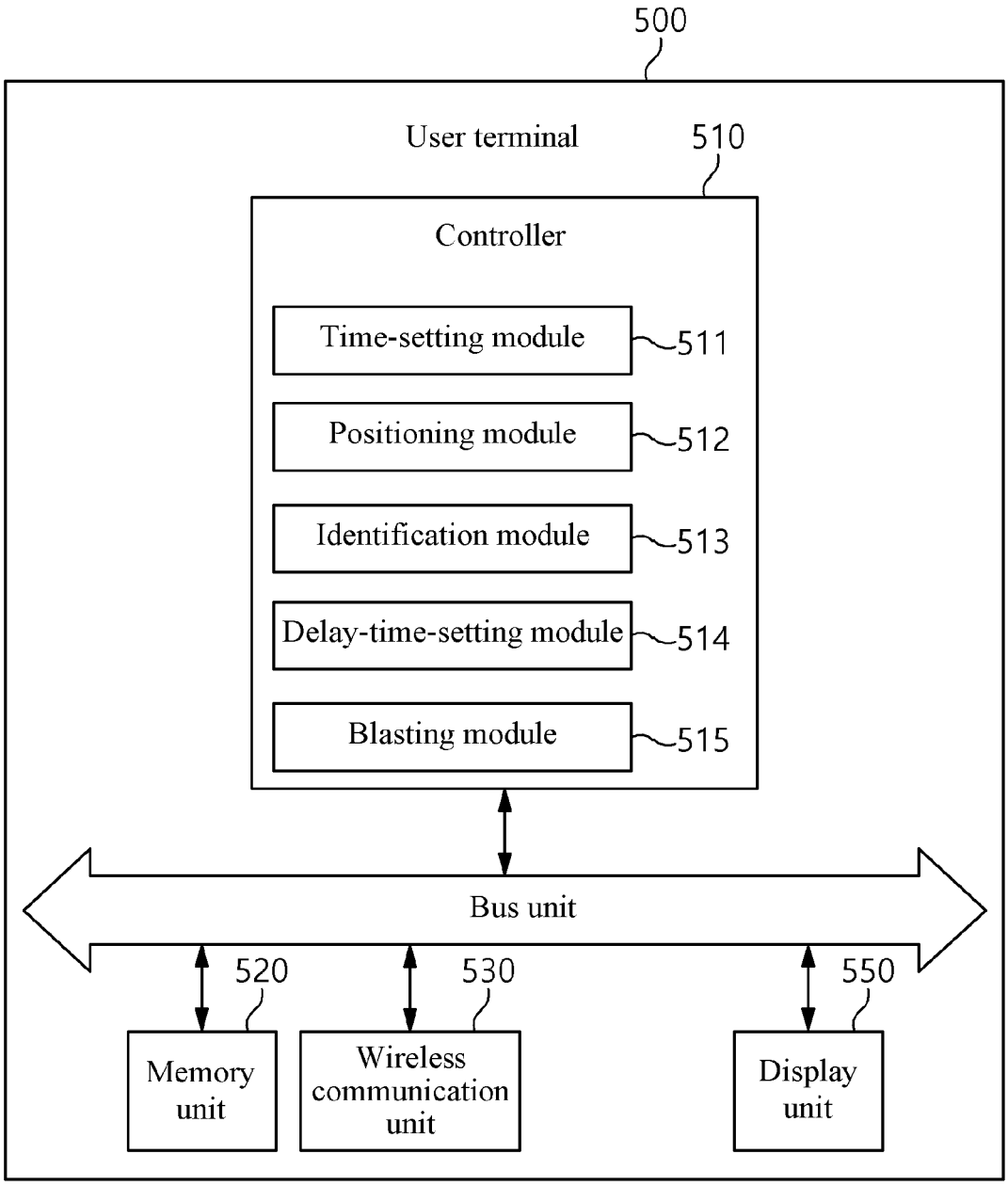

【FIG. 12】
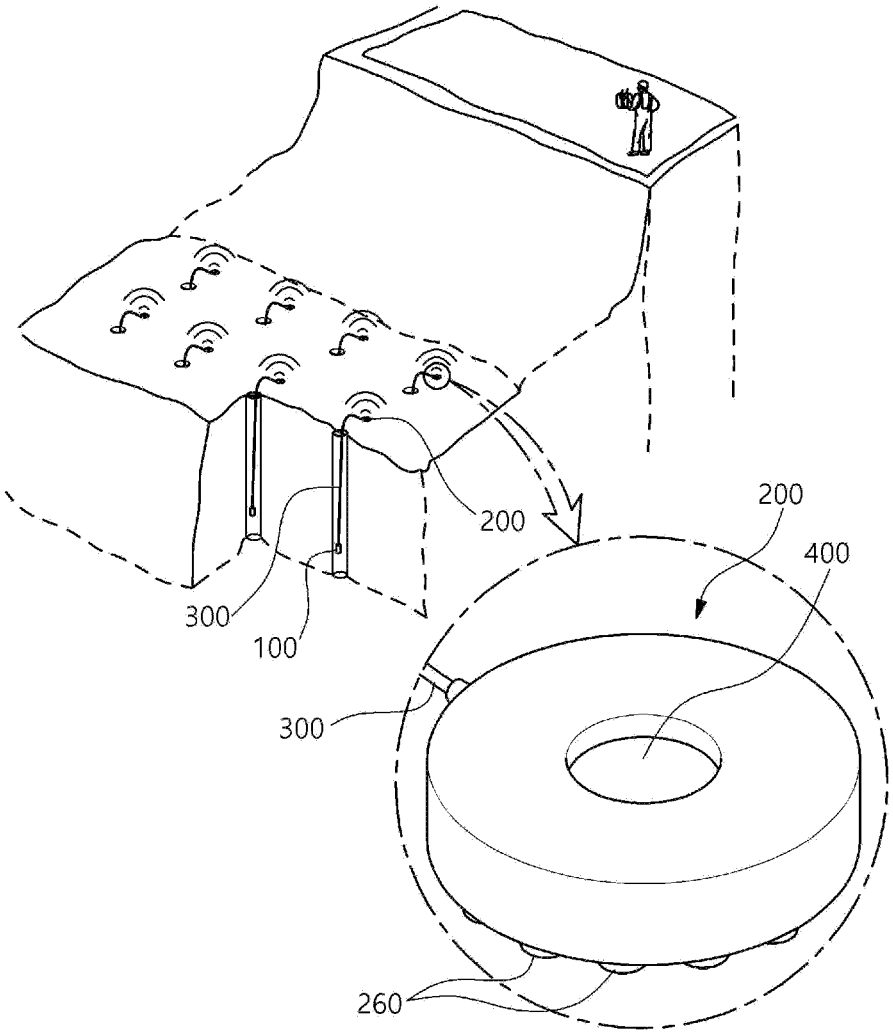

GROUND-FIXABLE ELECTRONIC DETONATION DEVICE FOR BLASTING SYSTEM AND BLASTING SYSTEM USING SAME

TECHNICAL FIELD

The present disclosure relates to a ground-fixable electronic detonation device for a blasting system and a blasting system using the same. More particularly, present disclosure relates to a ground-fixable electronic detonation device, which is capable of positioning and fixing a wireless communication module on the ground, for a blasting system and a blasting system using the same.

BACKGROUND ART

In general, explosives are used in engineering work, such as rock blasting for tunnel construction and building demolition. In particular, a plurality of holes, into which explosives are to be inserted, is drilled corresponding to the sections of a blasting target, i.e. the object to be blasted.

After an explosive is inserted into each of the drilled holes, the explosives are connected to a user terminal.

The explosives are exploded by operating the user terminal, thereby blasting the blasting target.

As a detonation device for explosives, a wireless-communication-type detonation device or a wired-communication-type detonation device may be used.

Conventionally, an electronic detonation device using wireless communication includes an electronic detonator, a wireless communication module, and wires connecting the wireless communication module to the electronic detonator.

The wireless communication module has an antenna therein for wireless communication provided to communicate with a user terminal.

In the electronic detonation device using wireless communication, it is preferable that the wireless communication module is positioned to face the sky, but a separate support is used for fixing the position of the wireless communication module after installation of the electronic detonation device.

When the position of the wireless communication module is fixed by using the separate support, cost for manufacturing the support suitable for the wireless communication module is incurred, and it is difficult to install the support separately on the ground and to hold the wireless communication module on the installed support.

DISCLOSURE

Technical Problem

Accordingly, the present disclosure has been made keeping in mind the above problems occurring in the prior art, and an objective of the present disclosure is to provide a ground-fixable electronic detonation device for a blasting system and a blasting system using the same, wherein a module fixing pin part is driven into the ground to fix a position of a wireless communication module.

Another objective of the present disclosure is to provide a ground-fixable electronic detonation device for a blasting system and a blasting system using the same, wherein a wireless communication module is held to be spaced apart from the ground, so that the stable wireless communication is performed regardless of a placement direction of the wireless communication module on the ground.

A further objective of the present disclosure is to provide a ground-fixable electronic detonation device for a blasting system and a blasting system using the same, wherein an electronic detonator is held by a wireless communication module for easy storage and portability.

Technical Solution

A ground-fixable electronic detonation device for a blasting system according to an embodiment of the present disclosure to accomplish the above objective includes: an electronic detonator; a wireless communication module; a wire part configured to connect the electronic detonator to the wireless communication module; and a module fixing pin part positioned in the wireless communication module and configured to move upward and downward to be driven into the ground.

The wireless communication module may include: a communication module housing part; and an antenna part positioned in the communication module housing part, and a wireless communication controller configured to control operation of the electronic detonator by a signal transmitted from the antenna part, wherein the communication module housing part may have a donut shape with a hollow portion at a center portion, and the module fixing pin part may be positioned in the hollow portion of the communication module housing part.

The housing support protrusions may be positioned with an interval in which the electronic detonator may be fitted, so that electronic detonator may be stored while being fitted in the interval.

The module fixing pin part may include: a raising and lowering body member positioned in the hollow portion of the communication module housing part and configured to move upward and downward; and a fixing pin member positioned to protrude on a lower portion of the raising and lowering body member, wherein the raising and lowering body member may have a thickness thicker than a height of each of the housing support protrusions, so that when the lower portion of the raising and lowering body member is seated on the ground while the fixing pin member is driven into the ground, a portion of a body of the raising and lowering body member may be positioned in the hollow portion of the communication module housing part.

A position fixing groove may be positioned on an outer circumferential surface of the raising and lowering body member, and the ground-fixable electronic detonation device may further include: a first position fixing member positioned at an upper portion of the communication module housing part and configured to protrude into the hollow portion and be inserted into the position fixing groove; and a first linear movement device configured to insert the first position fixing member into the position fixing groove or separate the first position fixing member from the position fixing groove by moving the first position fixing member forward and rearward.

The ground-fixable electronic detonation device may further include: a second position fixing member positioned at a lower portion of the communication module housing part, and configured to be inserted into the position fixing groove so that a protruding position of the raising and lowering body member is fixed to a height corresponding to a height of each of the housing support protrusions in the lower portion of the communication module housing part; a second linear movement device configured to move the second position fixing member forward and rearward; and a raising and lowering position detection sensor detecting a position of the raising and lowering body member.

The raising and lowering position detection sensor may be positioned at an end of the second position fixing member.

The ground-fixable electronic detonation device may further include: a fixing pin raising and lowering device positioned in the communication module housing part and configured to move the raising and lowering body member upward and downward.

A groove-shaped rail part may be positioned on an inner circumferential surface of the hollow portion of the communication module housing part and configured to guide up and down movement of the raising and lowering body member, a movement guide member may be positioned to protrude on an outer circumferential surface of the raising and lowering body member, and be configured to guide the up and down movement of the raising and lowering body member while being moved upward and downward in the rail part, and the fixing pin raising and lowering device may include: a rack gear member positioned in the communication module housing part while being upright; and a pinion gear member positioned in the movement guide member to be rotatable by engaging with the rack gear member and configured to be rotatable in opposite directions by a rotary motor.

A contact sensor may be positioned on a lower surface of the raising and lowering body member, and configured to detect contact between the lower surface of the raising and lowering body member and the ground and to stop operation of the fixing pin raising and lowering device.

A plurality of fixing pin members may be positioned on the raising and lowering body member to be respectively rotatable, and the ground-fixable electronic detonation device may further include pin rotation devices that may be positioned in the raising and lowering body member and configured to respectively rotate the plurality of fixing pin members.

Each of the pin rotation devices may include: a first bevel gear member positioned at a pin shaft of the fixing pin member; a second bevel gear member positioned at a main shaft that is rotatably positioned in the raising and lowering body member; and a pin rotary motor configured to rotate the main shaft.

A spiral groove or a spiral protrusion may be positioned on an outer circumferential surface of the fixing pin member.

The raising and lowering body member may be positioned at a center in a longitudinal direction of the hollow portion of the communication module housing part, and the plurality of fixing pin members may be rotatably positioned on each of an upper surface of a lower surface of the raising and lowering body member and configured to be rotated by the pin rotation devices, and the housing support protrusions may be positioned on each of an upper surface and the lower surface of the communication module housing part.

A first ground contact sensor may be positioned in an upper surface of each of the housing support protrusions positioned on the upper surface of the communication module housing part, and a second ground contact sensor may be positioned in a lower surface of each of the housing support protrusions positioned on the lower surface of the communication module housing part.

The ground-fixable electronic detonation device may further include: a wire winding reel part to which the wireless communication module is detachably coupled and the wire part is windable.

The wire winding reel part may include: a wire winding part onto which the wire part is wound; and a first panel and a second panel that may be positioned at opposite ends of the wire winding part and enable the wireless communication module to be seated on an upper portion of the wire winding reel part.

The wireless communication module further may include a cylindrical reel coupling member that is screwed-coupled to an outer circumferential surface of the communication module housing part, and outer circumferential surfaces of the first panel and the second panel may have respective module coupling screw parts to which the cylindrical reel coupling member may be capable of being screwed-coupled.

A blasting system may include: an electronic detonation device for the blasting system; and a user terminal that wirelessly communicates with the electronic detonation device for the blasting system through wireless communication and controls operation of the electronic detonation device for the blasting system, wherein the electronic detonation device for the blasting system is an embodiment of the ground-fixable electronic detonation device for a blasting system.

Advantageous Effects

As described above, according to the present disclosure, the module fixing pin part is driven into the ground to stably fix the position of the wireless communication module, so that stability in wireless communication is secured. Accordingly, the blasting accuracy can be improved.

According to the present disclosure, the wireless communication module is held to be spaced apart from the ground and an antenna with the highest signal strength among two antennas is selected for communication. Therefore, stable wireless communication can be performed regardless of a placement direction of the wireless communication module on the ground, and the blasting accuracy and stability can be secured at the same time.

According to the present disclosure, the electronic detonator is held by the wireless communication module for easy storage and portability. Therefore, convenience in use and convenience in storage can be secured at the same time.

DESCRIPTION OF DRAWINGS

FIG. 1 is a view showing a ground-fixable electronic detonation device for a blasting system according to a first embodiment of the present disclosure;

FIGS. 2 and 3 are section views showing the ground-fixable electronic detonation device for a blasting system according to the first embodiment of present disclosure;

FIGS. 4 and 5 are views showing a ground-fixable electronic detonation device for a blasting system according to a second embodiment of the present disclosure;

FIGS. 6 and 7 are view showing a ground-fixable electronic detonation device for a blasting system according to a third embodiment of the present disclosure;

FIGS. 8 and 9 are section views showing a ground-fixable electronic detonation device for a blasting system according to a fourth embodiment of the present disclosure;

FIG. 10 is a block diagram showing an embodiment of a blasting system using the ground-fixable electronic detonation device for a blasting system according to the present disclosure;

FIG. 11 is a block diagram showing an embodiment of a user terminal of the blasting system using the ground-fixable electronic detonation device for a blasting system according to the present disclosure; and FIG. 12 is a view schematically showing a use example of the ground-fixable electronic detonation device for a blasting system according to the present disclosure.

DESCRIPTION OF REFERENCE NUMERALS

100: electronic detonator
200: wireless communication module
210: communication module housing part
210*a*: rail part
220: first antenna part
230: second antenna part
240: wireless communication controller
250: antenna switch part
260: housing support protrusions
261: first ground contact sensor
262: second ground contact sensor
270: cylindrical reel coupling member
280: fixing pin raising and lowering device
281: rack gear member
282: pinion gear member
300: wire part
310: wire winding reel part
311: wire winding part
312: first panel
313: second panel
314: module coupling screw part
400: module fixing pin part
410: raising and lowering body member
410*a*: movement guide member
410*b*: contact sensor
411: position fixing groove
420: fixing pin member
430: first position fixing member
440: first linear movement device
450: second position fixing member
451: raising and lowering position detection sensor
460: second linear movement device
470: pin rotation devices
471: pin shaft
472: first bevel gear member
473: main shaft
474: second bevel gear member
475: pin rotary motor
500: user terminal

BEST MODE

Hereinafter, the present disclosure will be described in detail.

Exemplary embodiments of the present disclosure will be described in detail with reference to the accompanying drawings as follows. Prior to the detailed description of the present disclosure, all terms or words used in the description and claims should not be interpreted as being limited merely to common and dictionary meanings. Meanwhile, the embodiments described in the specification and the configurations illustrated in the drawings are merely examples, and do not exhaustively present the technical spirit of the present disclosure. Accordingly, it should be appreciated that there may be various equivalents and modifications that can replace the embodiments and the configurations at the time at which the present application is filed.

FIG. 1 is a view showing a ground-fixable electronic detonation device for a blasting system according to a first embodiment of the present disclosure. FIGS. 2 and 3 are section views showing the ground-fixable electronic detonation device for a blasting system according to the first embodiment of present disclosure.

Hereinbelow, the ground-fixable electronic detonation device for a blasting system according to the first embodiment of the present disclosure will be described in detail with reference to FIGS. 1 to 3.

The ground-fixable electronic detonation device for a blasting system according to the first embodiment of the present disclosure includes an electronic detonator 100, a wireless communication module 200, and a wire part 300 connecting the electronic detonator 100 to the wireless communication module 200.

The electronic detonator 100 stores detonator information and is detonated in response to a blast command to explode an explosive.

The wire part 300 may be wound or folded several times and then stored using a wire band or a wire tie, and may be unfolded when in use.

The wire part 300 may be implemented as various shapes using known electric wires for communication, and a detailed description thereof will be omitted.

The wireless communication module 200 includes a communication module housing part 210 an antenna part positioned in the communication module housing part 210, and a wireless communication controller 240 controlling operation of the electronic detonator 100 by a signal transmitted from the antenna.

As an example, the communication module housing part 210 may have a donut shape in which a hollow portion is positioned in the center thereof. The communication module housing part 210 may have a space to receive an antenna part 220, 230 and the wireless communication controller 240 controlling the operation of the electronic detonator 100 by a signal transmitted from the antenna part 220, 230.

The antenna part includes a first antenna part 220 positioned at an upper portion in the communication module housing part 210; a second antenna part 230 positioned to be spaced apart from a lower side of the first antenna part 220 in the communication module housing part 210.

Furthermore, the wireless communication module 200 may include an antenna switch part 250 to selectively connect any one of the first antenna part 220 and the second antenna part 230 to the wireless communication controller 240.

The first antenna part 220 is positioned to be in close contact with an upper surface of the communication module housing part 210, and the second antenna part 230 is positioned to be in close contact with a lower surface of the communication module housing part 210, thereby maximally securing the intervals and maximizing the distance between the second antenna part 230 and the upper surface of the communication module housing part 210, and maximizing the distance between the first antenna part 220 and the lower surface of the communication module housing part 210.

Accordingly, when the upper surface of the communication module housing part 210 is seated on the ground, the second antenna part 230 may be located to face the sky with the maximum distance from the ground. On the other hand, when the lower surface of the communication module housing part 210 is seated on the ground, the first antenna part 220 may be located to face the sky with the maximum distance from the ground.

Using a means such as an automatic signal recognition chip or a packet interne grouper (PING), the wireless communication controller 240 or the antenna switch part 250 may select an antenna with high signal strength among the first antenna part 220 and the second antenna part 230 and receive a signal from the selected antenna.

Regardless of the placement direction of the communication module housing part 210 on the ground, the wireless communication module 200, any one of the first antenna part 220 and the second antenna part 230 may be positioned toward the sky at the upper portion of the wireless communication module 200 and may be stably communicated in wireless manner with a user terminal.

A module fixing pin part 400 moving upward and downward to be driven into the ground is positioned in the hollow portion. The module fixing pin part 400 may include a raising and lowering body member 410 positioned in the hollow portion and moving upward and downward and a fixing pin member 420 positioned to protrude on a lower portion of the raising and lowering body member 410.

A ring-shaped locking step is positioned on an inside circumference of an upper portion of the hollow portion to prevent the raising and lowering body member 410 from being separated upward.

A plurality of housing support protrusions 260 is positioned on a lower surface of the communication module housing part 210 to separate the communication module housing part 210 from the ground.

The housing support protrusions 260 protrude while being spaced apart from each other on the lower surface of the communication module housing part 210.

When the communication module housing part 210 is seated on the ground, the housing support protrusions 260 separates the lower surface of the communication module housing part 210 from the ground, so that the strength of a signal transmitted to the second antenna part 230 positioned on the lower surface thereof may be increased.

The housing support protrusions 260 are positioned with an interval in which the electronic detonator 100 is fitted, so that the electronic detonator 100 is stored while being fitted in the interval.

The housing support protrusions 400 may be made of elastic materials, such as urethane, synthetic rubber, and silicone, so that the electronic detonator 100 may be stably fitted therein and may be stored with safer protection from external impact.

The raising and lowering body member 410 has a thickness thicker than a height of each of the housing support protrusions 260, so that a portion of the raising and lowering body member 410 is positioned in the hollow portion when the fixing pin member 420 is driven into the ground.

When the thickness of the raising and lowering body member 410 is equal to or less than the height of the housing support protrusion 260, the raising and lowering body member 410 may be removed from the hollow portion due to the housing support protrusion 260 while the fixing pin member 420 is driven into the ground, so the raising and lowering body member 410 may not serve to fix the position of the communication module housing part 210.

As the ground-fixable electronic detonation device for a blasting system according to the present disclosure is held by the wireless communication module 200, storage and portability of the electronic detonator become easy, and thus convenience in use and storage may be secured.

Each of the housing support protrusions 400 is configured to have a height that is at least equal to or higher than a diameter or the maximum thickness of the electronic detonator 100, so that the electronic detonator 100 fitted between the housing support protrusions 400 may be positioned to be stably held without being in contact with the ground.

In addition, the electronic detonator 100 is fit-coupled to the housing support protrusions 260 and positioned to cross the hollow portion, so that a lower end of the fixing pin member 420 may be supported by an upper portion of the electronic detonator 100 to prevent lowering of the fixing pin member 420.

Although not shown in the drawings, a lower end of the hollow portion may include a stopper for a fixing pin that is removably coupled to the hollow portion and blocks the lowering of the module fixing pin part 400.

The stopper for a fixing pin is coupled to the hollow portion with a known removable method such as force fitting or screw coupling. When the ground-fixable electronic detonation device for a blasting system according to the present disclosure is not in use or is not being carried, the stopper for a fixing pin prevents the module fixing pin part 400 from being lowered and protruding through a lower portion of the wireless communication module 200.

For example, the fixing pin member 420 has a pointed end to be easily driven into the ground, and the stopper for a fixing pin blocks a lower end of the hollow portion to prevent the pointed fixing pin member 420 from protruding through the lower portion of the wireless communication module 200.

When the fixing pin member 420 with the pointed end protrudes through the lower portion of the wireless communication module 200, it is difficult to store and carry the ground-fixable electronic detonation device and injury to an operator may occur. However, the stopper for a fixing pin blocks a lower portion of the hollow portion for solution of the above problems.

Meanwhile, a position fixing groove 411 is positioned on an outer circumferential surface of the raising and lowering body member 410. The ground-fixable electronic detonation device for a blasting system according to the present disclosure may include: a first position fixing member 430 protruding into the hollow portion from the communication module housing part 210 and be inserted into the position fixing groove 411; and a first linear movement device 440 configured to insert the first position fixing member 430 into the position fixing groove 411 or separate the first position fixing member 430 from the position fixing groove 411 by moving the first position fixing member 430 forward and rearward.

The first position fixing member 430 is inserted into the position fixing groove 411 to prevent the lowering of the module fixing pin part 400. Whereby, the position of the module fixing pin part 400 is locked, and the module fixing pin part 400 is positioned in the hollow portion, that is, the lower end of the fixing pin member 420 does not protrude through the lower portion of the hollow portion.

The first linear movement device 440 is connected to the wireless communication controller and wirelessly communicates with the user terminal, so that the operation thereof may be controlled. In addition, the first linear movement device 440 receives an operational signal from the user terminal to move backward the first position fixing member 430 and to separate the first position fixing member 430 from the position fixing groove 411. Accordingly, the module fixing pin part 400 may be lowered and fixed into the ground.

The first position fixing member 430 is positioned at an upper portion of the communication module housing part 210. The ground-fixable electronic detonation device for a blasting system according to the present disclosure may include: a second position fixing member 450 positioned at a lower portion of the communication module housing part 210, and configured to be inserted into the position fixing groove 411 so that a protruding position of the raising and lowering body member 410 is fixed to a height corresponding to a height of each of the housing support protrusions 260 in the lower portion of the communication module housing part 210; a second linear movement device 460 configured to move the second position fixing member 450 forward and rearward; and a raising and lowering position detection sensor 451 detecting a position of the raising and lowering body member 410.

The raising and lowering position detection sensor 451 is positioned at an end of the second position fixing member 450. When the raising and lowering body member 410 is lowered, the raising and lowering position detection sensor 451 may detect that the position fixing groove 411 is positioned at a position corresponding to the second position fixing member 450.

For example, the raising and lowering position detection sensor 451 may be a laser distance sensor, and may detect that a distance is increased by the position fixing groove 411, when the position fixing groove 411 is positioned at a position corresponding to the second position fixing member 450, to detect that the position fixing groove 411 is in a position corresponding to the second position fixing member 450. In addition, the raising and lowering position detection sensor 451 may be implemented by various modifications using a known sensor capable of detecting that the position fixing groove 411 is positioned at a position corresponding to the second position fixing member 450.

The position fixing groove 411 is positioned at an upper end of the raising and lowering body member 410, so that the lower portion of the raising and lowering body member 410 partially protrudes to a height corresponding to a height of the housing support protrusions 260 while the second position fixing member 450 is inserted in the position fixing groove 411.

When the lower portion of the raising and lowering body member 410 partially protrudes to a height corresponding to a height of the housing support protrusions 260 while the raising and lowering body member 410 is lowered and the fixing pin member 420 is driven into the ground, the raising and lowering position detection sensor 451 detects that the position fixing groove 411 is positioned at a height corresponding to the second position fixing member 450.

Then, when the second position fixing member 450 is moved forward and inserted into the position fixing groove 411 by the operation of the second linear movement device 460, the second position fixing member 450 fixes the position of the raising and lowering body member 410.

The lower-portion of the raising and lowering body member 410 partially protrude to a height corresponding the height of the housing support protrusions 260 to support the position of the communication module housing part 210. Accordingly, the communication module housing part 210 may be stably positioned.

FIGS. 4 and 5 are views showing a ground-fixable electronic detonation device for a blasting system according to a second embodiment of the present disclosure. Referring to FIGS. 4 and 5, the ground-fixable electronic detonation device for a blasting system according to the second embodiment of the present disclosure may include a fixing pin raising and lowering device 280 positioned in the communication module housing part 210 and moving the raising and lowering body member 410 upward and downward.

The raising and lowering body member 410 is lowered by the fixing pin raising and lowering device 280. A portion of a lower end thereof protrudes from the lower surface of the communication module housing part 210 and may protrude to a height corresponding to the height of the housing support protrusion 260.

A portion of the lower portion of the raising and lowering body member 410 protrudes to a height corresponding to the height of the housing support protrusion 260 to support the position of the communication module housing part 210. Accordingly, the communication module housing part 210 may be stably positioned, and the entire portion of the fixing pin member 420 may be driven into the ground to stably fix the position of the communication module housing part 210.

A groove-shaped rail part 210*a* is positioned on an inner circumferential surface of the hollow portion to guide up and down movement of the raising and lowering body member 410. A movement guide member 410*a* is positioned to protrude on an outer circumferential surface of the raising and lowering body member 410, and is configured to guide the up and down movement of the raising and lowering body member 410 while being moved upward and downward in the rail part 210*a*.

A plurality of rail parts 210*a* and a plurality of movement guide members 410*a* may be respectively positioned to correspond to each other to stably support the up and down movement of the raising and lowering body member 410.

The fixing pin raising and lowering device 280 may include a rack gear member 281 positioned in the communication module housing part 210 while being upright, and a pinion gear member 282 positioned in the movement guide member 410*a* to be rotatable by engaging with the rack gear member 281 and configured to be rotatable in opposite direction by a rotary motor.

A plurality of fixing pin raising and lowering devices 280 may be positioned in the communication module housing part 210 and be operated together to allow the raising and lowering body member 410 to be stably raised and lowered.

The fixing pin raising and lowering device 280 may allow the fixing pin member 420 to be driven into the ground and to be removed from the ground by moving the raising and lowering body member 410 upward and downward in response to a rotational direction of the pinion gear member 282 positioned in the movement guide member 410*a*.

The fixing pin raising and lowering device 280 is configured to move the raising and lowering body member 410 upward and downward, as the pinion gear member 282 positioned in the movement guide member 410*a* is rotate by engaging with the rack gear member 281 positioned in the communication module housing part 210 in the upright state. The fixing pin member 420 may be formed to have the maximum length in the hollow portion by minimizing a height of a clearance at the upper portion in the hollow portion that is required, when the raising and lowering body member 410 protrudes to a height corresponding to the height of the housing support protrusions 260 from the lower surface of the communication module housing part 210.

Accordingly, the position of the wireless communication module 200 may be stably fixed by increasing the length of the fixing pin member 420 driven into the ground.

Furthermore, a contact sensor 410*b* is positioned on a lower surface of the raising and lowering body member 410 and detects the contact between the lower surface of the raising and lowering body member 410 and the ground.

The operation of the fixing pin raising and lowering device 280 is stopped, when the contact sensor 410*b* detects the contact between the lower surface of the raising and lowering body member 410 and the ground. The fixing pin raising and lowering device 280 may fix the position of the raising and lowering body member 410 while the raising and lowering body member 410 is supported on the ground.

The plurality of fixing pin members 420 is positioned on the raising and lowering body member 410 to be respectively rotatable. According to a third embodiment of the present disclosure, the ground-fixable electronic detonation device for a blasting system may include pin rotation devices 470 that are positioned in the raising and lowering body member 410 and respectively rotates the plurality of fixing pin members 420.

The pin rotation devices 470 includes a first bevel gear member 472 positioned at a pin shaft 471 of the fixing pin member 420, a second bevel gear member 474 positioned at a main shaft 473 that is rotatably positioned in the raising and lowering body member 410, and a pin rotary motor 475 rotating the main shaft 473.

The pin rotary motor 475 is positioned in the movement guide member 410*a*, the main shaft 473 is arranged horizontally across the center of the raising and lowering body member 410, and a plurality of second bevel gear members 474 is positioned to be spaced apart from each other on the main shaft 473 and engages with the first bevel gear member 472 positioned in the fixing pin member 420.

A spiral groove or a spiral protrusion is positioned on an outer circumferential surface of the fixing pin member 420, so that the fixing pin member 420 may be easily driven into the ground by being rotated.

The pin rotation devices 470 are operated when the raising and lowering body member 410 is lowered by the fixing pin raising and lowering device 280 to allow the fixing pin member 420 to be easily driven into the ground.

FIGS. 6 and 7 are view showing a ground-fixable electronic detonation device for a blasting system according to a third embodiment of the present disclosure. Referring to FIGS. 6 and 7, the raising and lowering body member 410 is positioned at the center in a longitudinal direction of the hollow portion. The plurality of fixing pin members 420 may be positioned on each of an upper surface and the lower surface of the raising and lowering body member 410.

The housing support protrusions 260 may be positioned to protrude on each of the upper surface and the lower surface of the communication module housing part 210.

The raising and lowering body member 410 may be moved upward and downward by the fixing pin raising and lowering device 280, thereby being moved toward the upper surface or the lower surface of the communication module housing part 210.

A first ground contact sensor 261 may be positioned in an upper surface of each of upper-side housing support protrusions 260 positioned on the upper surface of the communication module housing part 210. A second ground contact sensor 262 may be positioned in a lower surface of each of lower-side housing support protrusions 260 positioned on the lower surface of the communication module housing part 210.

The first ground contact sensor 261 or the second ground contact sensor 262 detects a direction in which the communication module housing part 210 is placed on the ground to control the operation of the fixing pin raising and lowering device 280, so that the raising and lowering body member 410 may be moved toward the ground.

The fixing pin members 420 respectively positioned on each of the upper surface and the lower surface of the raising and lowering body member 410 may be rotatably positioned. The first bevel gear member 472 positioned in each pin shaft may be rotated by engaging with each of the second bevel gear member 474 positioned in the main shaft 473 that is arranged horizontally across the center of the raising and lowering body member 410.

The raising and lowering body member 410 is moved in a direction in which the communication module housing part 210 is placed on the ground to allow the fixing pin members 420 to be driven into the ground, regardless of whether the communication module housing part 210 is placed on the ground in an upper-surface direction or a lower-surface direction.

When the fixing pin members 420 are driven into the ground, the fixing pin member 420 are easily driven into the ground by the pin rotation devices 470. The raising and lowering body member 410 is lowered by the fixing pin raising and lowering device 280 and is seated on the ground, as a portion of the lower end thereof protrudes from the lower surface of the communication module housing part 210 and protrudes to a height corresponding to the height of the housing support protrusions 260. Accordingly, the position of the wireless communication module 200 spaced apart from the ground may be stably supported.

The contact sensor 410*b* is positioned in each of the upper surface and the lower surface of the raising and lowering body member 410. When the upper surface or the lower surface of the raising and lowering body member 410 is brought into contact with the ground, the operation of the fixing pin raising and lowering device 280 is stopped.

FIGS. 8 and 9 are section views showing a ground-fixable electronic detonation device for a blasting system according to a fourth embodiment of the present disclosure. Referring to FIGS. 8 and 9, the ground-fixable electronic detonation device for a blasting system according to the fourth embodiment of the present disclosure may include a wire winding reel part 310 to which the wireless communication module 200 is detachably coupled and the wire part 300 is windable.

The wire winding reel part 310 includes a wire winding part 311 onto which the wire part 300 is wound, and a first panel 312 and a second panel 313 that are positioned at opposite ends of the wire winding part 311 and enable the wireless communication module 200 to be seated on an upper portion of the wire winding reel part 310.

The wire winding part 311 has a cylindrical shape to store the wound wires without damages. The first panel 312 and the second panel 313 are circular panels with diameters larger than a diameter of the wire winding part 311, and have the diameters corresponding to a diameter of the wireless communication module 200.

The wireless communication module 200 includes a cylindrical reel coupling member 270 screwed-coupled to an outer circumferential surface of the communication module housing part 210. A module coupling screw parts 314 is positioned on each of outer circumferential surfaces of the first panel 312 and the second panel 313 to be screwed-coupled to cylindrical reel coupling member 270.

For storage, portability, and convenience in use of the long-length wire part 300, the wireless communication module 200 is coupled to the wire winding reel part 310, so that the wire part 300 may be stored by being wound onto the wire winding reel part 310.

As the cylindrical reel coupling member 270 is rotated and lowered to be screwed-coupled to the first panel 312 or the second panel 313 when the communication module housing part 210 is seated on the first panel 312 or the second panel 313, the wireless communication module 200 may be coupled to the wire winding reel part 310.

As the cylindrical reel coupling member 270 is rotated in a direction opposite to the coupling direction and is raised, the wireless communication module 200, which is screwed-coupled to the wire winding reel part 310 by the cylindrical reel coupling member 270, may be separated from the wire winding reel part 310.

The wireless communication module 200 may be used by being selectively coupled to the wire winding reel part 310, so that portability, storage, and convenience in use may be secured.

FIG. 10 is a block diagram showing an embodiment of a blasting system using the ground-fixable electronic detonation device for a blasting system according to the present disclosure. Referring to FIG. 8, the electronic detonator 100 may communicate wirelessly with a user terminal 500 through the wireless communication module 200 so as to synchronize automatically with the user terminal 500.

The electronic detonator 100 may communicate with the user terminal 500 using wired communication or wireless communication to receive detonation time information or to transmit identifier information and positioning information to the user terminal 500.

Detonator information may include detonation time information, blast delay time information, identifier information, and positioning information.

The electronic detonator 100 may receive a blast command from the user terminal 500 to explode an explosive. When the electronic detonator 100 starts to count a blast delay time included in the blast command and the counting is completed, that is, after the blast delay time, the electronic detonator 100 detonates and explodes the explosive.

The wireless communication module 200 may allow the user terminal 500 and the electronic detonator 100 to communicate wirelessly with each other over a wireless network.

The wireless network may perform wireless communication by using known wireless networks, such as mobile radio communication networks including long-term evolution (LTE), Bluetooth™, Wi-Fi, wireless broadband interne (Wi-Bro), and long range network (LoRa).

The user terminal 500 may synchronize with the electronic detonator 100 to transmit detonation time information to the electronic detonator 100 or to receive the identifier information and the positioning information from the electronic detonator 100.

Further, the user terminal 500 may transmit respective blast commands including blast delay times to a plurality of electronic detonators 100.

FIG. 11 is a block diagram showing an embodiment of the user terminal 500 of the blasting system using the ground-fixable electronic detonation device for a blasting system according to the present disclosure.

Referring to FIGS. 1, 10, and 11, the embodiment of the user terminal 500 of the blasting system using the ground-fixable electronic detonation device for a blasting system will be described in detail.

The user terminal 500 may include a controller 510, a memory unit 520, a wireless communication unit 530, a display unit 550, and a bus unit 560.

The controller 510 may control the overall operation of the user terminal 500. According to the embodiment, the controller 510 may be implemented as a central processing unit (CPU), a microprocessing unit (MPU), a graphics processing unit (GPU), or the like.

The memory unit 520 may store a plurality of commands constituting a program that may be executed by the controller 510, components list data for a components list, and components property data indicating properties of components. Depending on the embodiment, the memory unit 520 may be implemented as read-only memory (ROM), random access memory (RAM), a hard disk drive (HDD), a solid-state drive (SSD), or the like.

The wireless communication unit 530 may perform communication between the user terminal 500 and the electronic detonator 100. For example, the wireless communication unit 530 may communicate with the wireless communication module 200 over a wireless network. According to the embodiment, the wireless communication unit 530 may use various types of wireless networks, such as mobile radio communication networks including long-term evolution (LTE), Bluetooth™, Wi-Fi, wireless broadband interne (Wi-Bro), long range network (LoRa), etc., to perform communication.

The display unit 550 may display an image. For example, the display unit 550 may be implemented as a display panel. According to the embodiment, the display unit 550 may be implemented as any one of a liquid crystal display device), an organic light-emitting display device, and the like, but the present disclosure is not limited thereto, and the display unit 550 may be implemented as any of various devices as long as the display unit 550 serves the purpose of displaying an image. The display unit 550 may display the electronic detonator 100 on a map on the basis of the identifier information and the positioning information received from the electronic detonator 100.

The bus unit 560 may perform data transmission and reception between the controller 510, the memory unit 520, the wireless communication unit 530, and the display unit 550. Depending on the embodiment, the bus unit 560 may be implemented as a bus interface.

The controller 510 may include a time-setting module 511, a positioning module 512, an identification module 513, a delay-time-setting module 514, and a blasting module 515. In the specification, a module may be software (a program) in which the commands constituting the program stored in the memory unit 520 are executed by the controller 510.

The time-setting module 511 may set the detonation time corresponding to the electronic detonator 100.

When the user terminal 500 is synchronized with the electronic detonator 100, the time-setting module 511 may set the detonation time and transmit the detonation time information indicating the detonation time to the electronic detonator 100 through the wireless communication unit.

The positioning module 512 may check the position of the electronic detonator 100. When the user terminal 500 is synchronized with the electronic detonator 100, the positioning module 512 may receive the positioning information from the electronic detonator 100 through the wireless communication unit 530. Further, the positioning module 512 may check the position of the electronic detonator 100 using the positioning information.

The identification module 513 may detect an identifier by receiving the identifier information of the electronic detonator 100. When the user terminal 500 synchronizes with the electronic detonator 100, the identification module 513 may receive the identifier information from the electronic detonator 100 through the wireless communication unit 530. Further, the identification module 513 may identify the electronic detonator 100 using the identifier information.

The delay-time-setting module 514 may set the blast delay time corresponding to the electronic detonator 100. For example, the blast delay time may be set in consideration of a delay time and a stepped difference. When the user terminal 500 synchronizes with the electronic detonator 100, the delay-time-setting module 514 may set the blast delay time.

The blasting module 515 may transmit a blast command including the blast delay time set by the delay-time-setting module 514 to the electronic detonator 100. For example, the blasting module 515 may transmit the blast command to the electronic detonator 100 through the wireless communication unit 530. The electronic detonator 100 may store the blast delay time information indicating the blasting delay time included in the received blast command.

FIG. 12 is a view schematically showing a use example of the ground-fixable electronic detonation device for a blasting system according to the present disclosure.

Referring to FIG. 12, the blasting system using the ground-fixable electronic detonation device for a blasting system according to the present disclosure is configured to insert the electronic detonator 100 into a blasting hole provided in the ground and then to blast the electronic detonator 100 by communicating with the user terminal via wireless communication or wired communication.

The wireless communication module 200 is seated and held on the ground, and may be positioned to be spaced apart from the ground, and the position of the wireless communication module may be stably fixed while the module fixing pin part 400 is driven into the ground.

According to the present disclosure, the position of the wireless communication module may be stably fixed to the ground as the module fixing pin part 400 is driven into the ground, so that stability in wireless communication may be secured and blasting accuracy may be improved.

The wireless communication module is held to be spaced apart from the ground and an antenna with the highest signal strength among the two antennas is selected for communication. Therefore, stable wireless communication may be performed regardless of the placement direction of the wireless communication module on the ground, and the blasting accuracy and stability may be secured at the same time.

According to the present disclosure, the electronic detonator is held to the wireless communication module for easy storage and portability, thereby securing convenience in use and convenience in storage at the same time.

The present disclosure is not limited to the above-described embodiments, and may be implemented as various modifications, additions and substitutions without departing from the scope and spirit of the present disclosure as disclosed in the accompanying claims, and the modifications and the like are included in the configuration of the present disclosure.

The invention claimed is:

1. A ground-fixable electronic detonation device for a blasting system, the ground-fixable electronic detonation device comprising:

an electronic detonator;

a wireless communication module;

a wire part configured to connect the electronic detonator to the wireless communication module; and a module fixing pin part positioned in the wireless communication module and configured to move upward and downward to be driven into the ground.

2. The ground-fixable electronic detonation device of claim 1, wherein the wireless communication module comprises:

a communication module housing part; and an antenna part positioned in the communication module housing part, and a wireless communication controller configured to control operation of the electronic detonator by a signal transmitted from the antenna part, wherein the communication module housing part has a donut shape with a hollow portion at a center portion, and the module fixing pin part is positioned in the hollow portion of the communication module housing part.

3. The ground-fixable electronic detonation device of claim 2, wherein a plurality of housing support protrusions is positioned on a lower surface of the communication module housing part to separate the communication module housing part from the ground.

4. The ground-fixable electronic detonation device of claim 3, wherein the housing support protrusions are positioned with an interval in which the electronic detonator is fitted, so that electronic detonator is stored while being fitted in the interval.

5. The ground-fixable electronic detonation device of claim 3, wherein the module fixing pin part comprises:

a raising and lowering body member positioned in the hollow portion of the communication module housing part and configured to move upward and downward; and a fixing pin member positioned to protrude on a lower portion of the raising and lowering body member, wherein the raising and lowering body member has a thickness thicker than a height of each of the housing support protrusions, so that when the lower portion of the raising and lowering body member is seated on the ground while the fixing pin member is driven into the ground, a portion of a body of the raising and lowering body member is positioned in the hollow portion of the communication module housing part.

6. The ground-fixable electronic detonation device of claim 5, wherein a position fixing groove is positioned on an outer circumferential surface of the raising and lowering body member, and the ground-fixable electronic detonation device further comprises:

a first position fixing member positioned at an upper portion of the communication module housing part and configured to protrude into the hollow portion and be inserted into the position fixing groove; and a first linear movement device configured to insert the first position fixing member into the position fixing groove or separate the first position fixing member from the position fixing groove by moving the first position fixing member forward and rearward.

7. The ground-fixable electronic detonation device of claim 6, further comprising:

a second position fixing member positioned at a lower portion of the communication module housing part, and configured to be inserted into the position fixing groove so that a protruding position of the raising and lowering body member is fixed to a height corresponding to a height of each of the housing support protrusions in the lower portion of the communication module housing part;

a second linear movement device configured to move the second position fixing member forward and rearward; and a raising and lowering position detection sensor detecting a position of the raising and lowering body member.

8. The ground-fixable electronic detonation device of claim 7, wherein the raising and lowering position detection sensor is positioned at an end of the second position fixing member.

9. The ground-fixable electronic detonation device of claim 5, further comprising:

a fixing pin raising and lowering device positioned in the communication module housing part and configured to move the raising and lowering body member upward and downward.

10. The ground-fixable electronic detonation device of claim 9, wherein a groove-shaped rail part is positioned on an inner circumferential surface of the hollow portion of the communication module housing part and configured to guide up and down movement of the raising and lowering body member, a movement guide member is positioned to protrude on an outer circumferential surface of the raising and lowering body member, and is configured to guide the up and down movement of the raising and lowering body member while being moved upward and downward in the rail part, and the fixing pin raising and lowering device comprises:

a rack gear member positioned in the communication module housing part while being upright; and a pinion gear member positioned in the movement guide member to be rotatable by engaging with the rack gear member and configured to be rotatable in opposite directions by a rotary motor.

11. The ground-fixable electronic detonation device of claim 9, wherein a contact sensor is positioned on a lower surface of the raising and lowering body member, and configured to detect contact between the lower surface of the raising and lowering body member and the ground and to stop operation of the fixing pin raising and lowering device.

12. The ground-fixable electronic detonation device of claim 9, wherein a plurality of fixing pin members is positioned on the raising and lowering body member to be respectively rotatable, and the ground-fixable electronic detonation device further comprises pin rotation devices that are positioned in the raising and lowering body member and configured to respectively rotate the plurality of fixing pin members.

13. The ground-fixable electronic detonation device of claim 12, wherein each of the pin rotation devices comprises:

a first bevel gear member positioned at a pin shaft of the fixing pin member;

a second bevel gear member positioned at a main shaft that is rotatably positioned in the raising and lowering body member; and a pin rotary motor configured to rotate the main shaft.

14. The ground-fixable electronic detonation device of claim 12, wherein a spiral groove or a spiral protrusion is positioned on an outer circumferential surface of the fixing pin member.

15. The ground-fixable electronic detonation device of claim 13, wherein the raising and lowering body member is positioned at a center in a longitudinal direction of the hollow portion of the communication module housing part, and the plurality of fixing pin members is rotatably positioned on each of an upper surface of a lower surface of the raising and lowering body member and configured to be rotated by the pin rotation devices, and the housing support protrusions are positioned on each of an upper surface and the lower surface of the communication module housing part.

16. The ground-fixable electronic detonation device of claim 15, wherein a first ground contact sensor is positioned in an upper surface of each of the housing support protrusions positioned on the upper surface of the communication module housing part, and a second ground contact sensor is positioned in a lower surface of each of the housing support protrusions positioned on the lower surface of the communication module housing part.

17. The ground-fixable electronic detonation device of claim 2, further comprising:

a wire winding reel part to which the wireless communication module is detachably coupled and the wire part is windable.

18. The ground-fixable electronic detonation device of claim 17, wherein the wire winding reel part comprises:

a wire winding part onto which the wire part is wound; and a first panel and a second panel that are positioned at opposite ends of the wire winding part and enable the wireless communication module to be seated on an upper portion of the wire winding reel part.

19. The ground-fixable electronic detonation device of claim 18, wherein the wireless communication module further comprises a cylindrical reel coupling member that is screwed-coupled to an outer circumferential surface of the communication module housing part, and outer circumferential surfaces of the first panel and the second panel have respective module coupling screw parts to which the cylindrical reel coupling member is capable of being screwed-coupled.

20. A blasting system comprising:

an electronic detonation device for the blasting system; and a user terminal that wirelessly communicates with the electronic detonation device for the blasting system through wireless communication and controls operation of the electronic detonation device for the blasting system, wherein the electronic detonation device for the blasting system is a ground-fixable electronic detonation device for a blasting system of claim 1.

* * * * *